US011111696B2

(12) United States Patent
Minter et al.

(10) Patent No.: US 11,111,696 B2
(45) Date of Patent: Sep. 7, 2021

(54) MAGNETICALLY-TRIGGERED LOCK MECHANISM

(71) Applicant: Interlock USA, Inc., Reno, NV (US)

(72) Inventors: Peter J. Minter, Reno, NV (US); Douglas Stadler, Reno, NV (US)

(73) Assignee: Interlock USA, Inc., Reno, NV (US)

( * ) Notice: Subject to any disclaimer, the term of this patent is extended or adjusted under 35 U.S.C. 154(b) by 571 days.

(21) Appl. No.: 15/995,970

(22) Filed: Jun. 1, 2018

(65) Prior Publication Data

US 2018/0347234 A1 Dec. 6, 2018

Related U.S. Application Data

(60) Provisional application No. 62/513,680, filed on Jun. 1, 2017.

(51) Int. Cl.
*E05B 47/00* (2006.01)
*E05C 1/02* (2006.01)
(Continued)

(52) U.S. Cl.
CPC ..... *E05B 47/0046* (2013.01); *E05B 47/0038* (2013.01); *E05B 63/20* (2013.01);
(Continued)

(58) Field of Classification Search
CPC . E05C 1/002; E05C 1/02; E05C 19/16; E05Y 2201/46; E05Y 2600/41;
(Continued)

(56) References Cited

U.S. PATENT DOCUMENTS 2,672,745 A 3/1954 Marchetti
4,848,812 A * 7/1989 Slaughter ..... E05C 19/163 292/144
(Continued)

FOREIGN PATENT DOCUMENTS

DE 3801441 A1 9/1988
FR 2713267 A1 6/1995
(Continued)

*Primary Examiner* — Kristina R Fulton
*Assistant Examiner* — Christopher F Callahan
(74) *Attorney, Agent, or Firm* — DeLio Peterson & Curcio LLC; David R. Pegnataro

(57) ABSTRACT

A lock mechanism for interengaging two relatively movable components includes a bolt mounted within a first component and interengageable with a second component when the first and second components are in a predetermined position relative to each other and the bolt is extended. A magnetically-releasable latch mechanism is positioned to latch the bolt in a retracted position and is mounted for movement between a biased latch engaging position and a latch releasing position in a non-common direction of movement of the bolt. A first magnet is disposed within a trigger being translatable along an axis parallel to a longitudinal axis of the bolt and a second magnet is positioned to displace the latch mechanism to the latch releasing position as the trigger is caused to translate vertically when the first component is in the predetermined position relative to the second component to permit displacement of the bolt to the extended position.

24 Claims, 6 Drawing Sheets

(51) Int. Cl.
*E05C 1/00* (2006.01)
*E05B 63/20* (2006.01)

(52) U.S. Cl.
CPC ..... *E05C 1/002* (2013.01); *E05C 1/02* (2013.01); *E05Y 2201/46* (2013.01); *E05Y 2600/41* (2013.01); *E05Y 2600/62* (2013.01)

(58) Field of Classification Search
CPC ..... E05Y 2600/62; Y10T 292/11; E05B 47/0046; E05B 47/0038; E05B 63/20; E05B 63/202
See application file for complete search history.

(56) References Cited

U.S. PATENT DOCUMENTS

| | | | | |
|---|---|---|---|---|
| 5,377,513 | A | 1/1995 | Miyamoto et al. | |
| 5,823,026 | A | 10/1998 | Finke | |
| 6,474,120 | B1 * | 11/2002 | Wadsworth | E05B 63/185 292/251.5 |
| 8,177,265 | B2 | 5/2012 | Stevens | |
| 8,382,168 | B2 | 2/2013 | Carabalona et al. | |
| 8,702,133 | B2 | 4/2014 | Sun et al. | |
| 8,764,071 | B2 | 7/2014 | Lanigan et al. | |
| 2002/0195828 | A1 | 12/2002 | Gebhard | |
| 2004/0239121 | A1 | 12/2004 | Morris | |
| 2006/0049645 | A1 * | 3/2006 | Drumm | E05C 19/163 292/251.5 |
| 2006/0220391 | A1 | 10/2006 | Gonzalez | |
| 2007/0194578 | A1 | 8/2007 | Boosey et al. | |
| 2008/0115543 | A1 | 5/2008 | Lanigan et al. | |
| 2009/0115204 | A1 | 5/2009 | Rycroft | |
| 2010/0263415 | A1 | 10/2010 | Ruspil | |
| 2011/0277517 | A1 | 11/2011 | Aschieri | |
| 2012/0167646 | A1 | 7/2012 | Sharma et al. | |
| 2015/0033808 | A1 | 2/2015 | Taylor et al. | |
| 2015/0330126 | A1 | 11/2015 | Ma et al. | |
| 2015/0354251 | A1 | 12/2015 | Woo | |
| 2018/0080257 | A1 | 3/2018 | Risi | |

FOREIGN PATENT DOCUMENTS

| | | | |
|---|---|---|---|
| GB | 2286627 | A | 8/1995 |
| WO | 2006070062 | A1 | 7/2006 |
| WO | 2009050328 | A1 | 4/2009 |

* cited by examiner

MAGNETICALLY-TRIGGERED LOCK MECHANISM

RELATED APPLICATIONS

This application claims priority to U.S. Provisional Patent App. No. 62/513,680 filed on Jun. 1, 2017, the entire disclosure of which is incorporated herein by reference.

BACKGROUND OF THE INVENTION

1. Field of the Invention

The present invention relates generally to a triggered bolt assembly for engaging two relatively movable components. More specifically, the present invention relates to a magnetically-triggered bolt assembly for engaging a window or door with a strike or frame to prevent access to the interior of an enclosure.

2. Description of Related Art

Bolt assemblies are a well-known means for preventing access to the interior of an enclosure or structure. Known bolt assemblies comprise two components, one of which is connected to one component of an enclosure, such as a door or window frame, and the other connected to the other component, such as a door. The first component typically includes a bolt displaceable between engaged and disengaged positions, and the second component comprises a socket into which the bolt may be extended when the two components are in an appropriate position relative to each other and the bolt is moved to the engaged position. The position of the bolt may be controlled manually by manipulation of a key or by energizing an interlock circuit so as to prevent opening of the enclosure except in predetermined safe conditions.

However, known bolt assemblies have disadvantages. For example, in bolt assemblies including a key, if the key is actuated to extend the bolt in circumstances where it is presumed that the two components of the bolt assembly are interengaged by the bolt but in fact the two components are not interengaged, unsafe conditions may prevail despite the bolt being extended. In a two component bolt assembly, it is not sufficient to ensure simply that the bolt is extended, as it may be that the bolt when extended has not engaged the other component of the assembly.

Therefore, there is a need for an improved bolt assembly which ensures that the bolt will not be triggered and extended until the two components are in the appropriate position relative to each other.

SUMMARY OF THE INVENTION

Bearing in mind the problems and deficiencies of the prior art, it is therefore an object of the present invention to provide an improved triggered bolt assembly for preventing access to the interior of an enclosure.

It is another object of the present invention to provide an improved bolt assembly which ensures that the bolt is extended only after the two components are in the appropriate position relative to each other.

A further object of the present invention is to provide a magnetically-triggered bolt assembly which ensures that the bolt is extended only after the two components are in the appropriate position relative to each other.

Still other objects and advantages of the invention will in part be obvious and will in part be apparent from the specification.

The above and other objects, which will be apparent to those skilled in the art, are achieved in the present invention which is directed to a magnetically-triggered lock mechanism for interengaging two relatively movable components. The lock mechanism comprises a bolt displaceable between extended and retracted positions, the bolt mounted within a first component and interengageable with a second component when the first and second components are in a predetermined position relative to each other and the bolt is extended, and a magnetically-releasable latch mechanism positioned to latch the bolt in a retracted position, the latch mechanism including a first magnet and mounted for movement between a biased latch engaging position and a latch releasing position in a non-common direction of movement of the bolt. The lock mechanism further comprises a second magnet positioned to displace the latch mechanism to the latch releasing position when the first component is in the predetermined position relative to the second component. The first and second magnets may be positioned to displace the latch mechanism to the latch releasing position as a result of magnetic repulsion when the first component is in the predetermined position relative to the second component.

The magnetically-releasable latch mechanism may comprise a locking shuttle in communication with a trigger housing and the first magnet may be positioned within the trigger housing. The locking shuttle is adapted to move in a direction perpendicular to the movement of the trigger housing as the latch mechanism moves between the biased latch engaging position and the latch releasing position. The trigger housing may include at least one angled surface for mating with an angled surface of the locking shuttle, wherein the mating angled surfaces of the trigger housing and locking shuttle translate vertical movement of the trigger housing into horizontal movement of the locking shuttle when the first component is in the predetermined position relative to the second component and the first and second magnets are positioned to displace the latch mechanism to the latch releasing position. The locking shuttle may further comprise a projection and the bolt may further comprise an aperture for receiving the locking shuttle projection when the latch mechanism is in the biased latch engaging position.

In one embodiment, the first component may be a door or window panel, and the second component may be a frame associated with the door or window panel, and the second magnet may be at least partially located within a recess in the frame.

The bolt may be normally biased toward the extended position, and the lock mechanism may further include an outer housing comprising a channel in an inner surface thereof, wherein the bolt translates vertically within the channel as the bolt moves between extended and retracted positions.

In another aspect, the present invention is directed to a door or window assembly comprising a door or window panel moveable relative to an associated frame, and a magnetically-triggered lock mechanism for interengaging the panel and the frame. The lock mechanism comprises a bolt displaceable between extended and retracted positions, the bolt mounted within the door or window panel and interengageable with the frame when the door or window panel and frame are in a predetermined position relative to each other and the bolt is extended, and a magnetically-releasable latch mechanism positioned to latch the bolt in a retracted position, the latch mechanism including a first magnet and mounted for movement between a biased latch engaging position and a latch releasing position in a non-common direction of movement of the bolt. The lock mechanism further includes a second magnet positioned to displace the latch mechanism to the latch releasing position when the door or window panel is in the predetermined position relative to the frame. The first and second magnets may be positioned to displace the latch mechanism to the latch releasing position as a result of magnetic repulsion when the door or window panel is in the predetermined position relative to the frame.

In still another aspect, the present invention is directed to a method of interengaging two relatively movable components to prevent access to an interior of an enclosure. The method comprises the steps of providing a bolt displaceable between extended and retracted positions, the bolt mounted within a first component and interengageable with a second component when the first and second components are in a predetermined position relative to each other and the bolt is extended; providing a magnetically-releasable latch mechanism positioned to latch the bolt in a retracted position, the latch mechanism including a first magnet and mounted for movement between a biased latch engaging position and a latch releasing position in a non-common direction of movement of the bolt; and providing a second magnet positioned to displace the latch mechanism to the latch releasing position when the first component is in the predetermined position relative to the second component. The method further comprises locating the first and second components in the predetermined position relative to each other; causing the latch mechanism to move to the latch releasing position as a result of magnetic interaction between the first and second magnets; and displacing the bolt to the extended position to interengage the second component. In an embodiment, the magnetic interaction between the first and second magnets may comprise magnetic repulsion. The first component may be a door or window panel, and the second component may be a frame associated with the door or window panel.

The latch mechanism may comprise a locking shuttle in communication with a trigger housing and the first magnet may be positioned within the trigger housing, and the step of causing the latch mechanism to move to the latch releasing position as a result of magnetic interaction between the first and second magnets may further comprise moving the locking shuttle in a direction perpendicular to the movement of the trigger housing as the latch mechanism moves between the biased latch engaging position and the latch releasing position.

The locking shuttle may comprise a projection and the bolt may comprise an aperture for receiving the locking shuttle projection when the latch mechanism is in the biased latch engaging position, and the step of causing the latch mechanism to move to the latch releasing position as a result of magnetic interaction between the first and second magnets may further comprise retracting the locking shuttle projection from the bolt aperture to allow the bolt to be displaced to the extended position.

The trigger housing may include at least one angled surface for mating with an angled surface of the locking shuttle, and the step of causing the latch mechanism to move to the latch releasing position as a result of magnetic interaction between the first and second magnets may further comprise translating vertical movement of the trigger housing into horizontal movement of the locking shuttle via the mating angled surfaces of the trigger housing and locking shuttle as the latch mechanism moves to the latch releasing position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
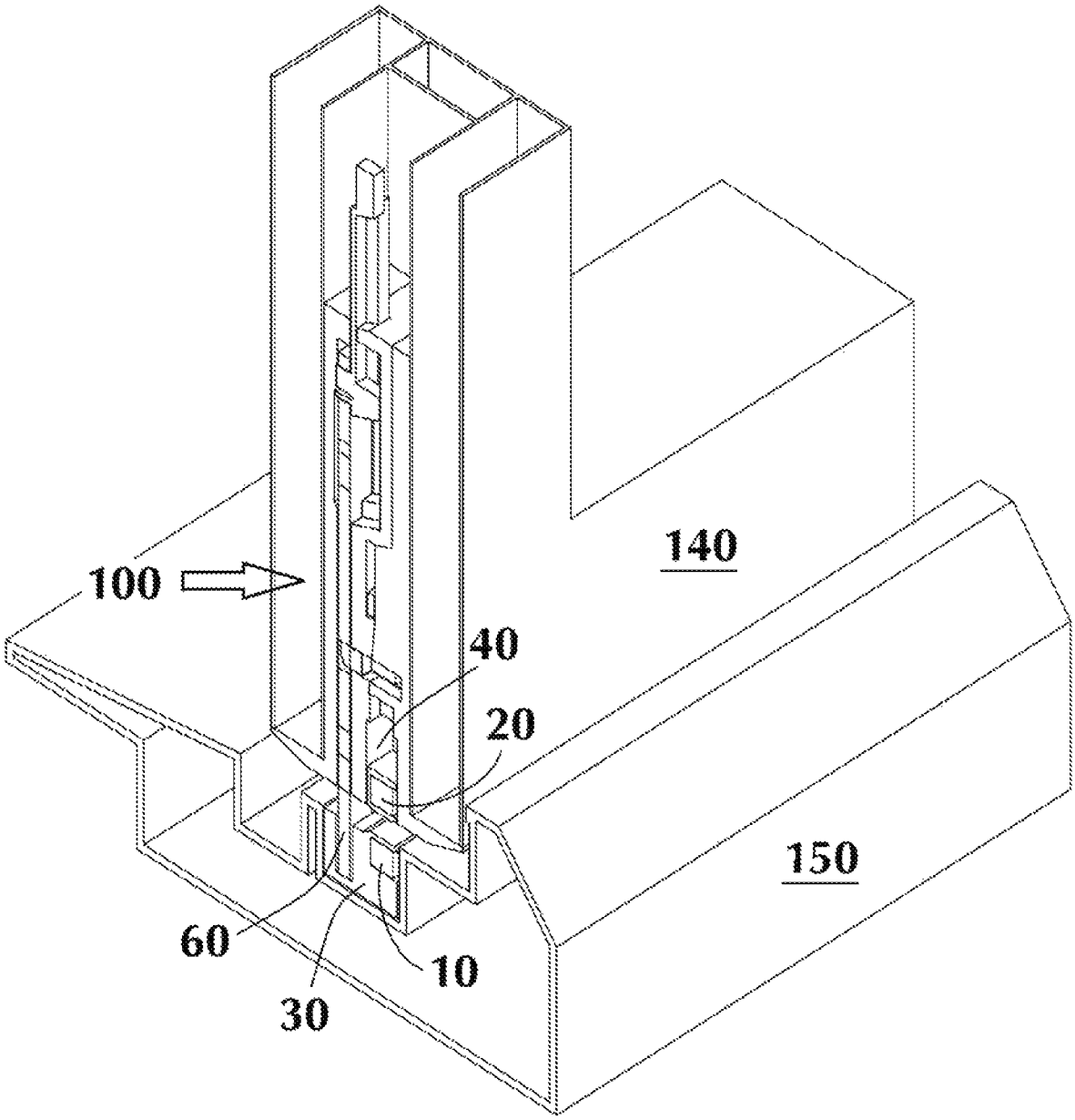
FIG. 1 is a perspective, cross-sectional view of an embodiment of the magnetically-triggered lock mechanism of the present invention mounted within an enclosure to prevent access to the interior of the enclosure.

In describing the embodiments of the present invention, reference will be made herein to FIGS. 1-9 of the drawings, in which like numerals refer to like features of the invention.

Certain terminology is used herein for convenience only and is not to be taken as a limitation of the invention. For example, words such as "upper," "lower," "left," "right," "horizontal," "vertical," "upward," "downward," "clockwise," and "counterclockwise" merely describe the configuration shown in the drawings. For purposes of clarity, the same reference numbers will be used in the drawings to identify similar elements.

Additionally, in the subject description, the word "exemplary" is used to mean serving as an example, instance or illustration. Any aspect or design described herein as "exemplary" is not necessarily intended to be construed as preferred or advantageous over other aspects or design. Rather, the use of the word "exemplary" is merely intended to present concepts in a concrete fashion.

An exemplary embodiment of the magnetically-triggered lock mechanism of the present invention is shown in FIGS. 1-7, inclusive. The lock mechanism includes a magnetically-triggered bolt mounted, for example, within a door panel movable between an open position and a closed position, and a strike positioned in the base of a door frame for receiving the triggered bolt when the door is in the locked position. It should be understood by those skilled in the art that the lock mechanism of the present invention is not limited to enclosures secured by a door, and may also be used to interengage other relatively movable components, such as a window frame and sill. Magnets secured in the strike and trigger mechanism for the bolt, respectively, are oriented and positioned such that they repel one another when in alignment, overcoming the forces of friction and trigger spring normally biasing the trigger in a downward direction, and pulling a locking shuttle away from the bolt, thereby allowing a compressed bolt spring to release and fire the bolt downward into the pocket of the strike.

Referring now to FIG. 1, one embodiment of a magnetically-triggered lock mechanism 100 of the present invention is shown mounted in a door panel 140, to secure the door panel to a door frame 150 to prevent access to the interior of an enclosure when bolt 60 is extended into an opening in a strike 30 in the bottom of the door frame. It should be understood by those skilled in the art that in other embodiments, door panel 140 may instead be a window frame and door frame 150 may be a window sill, or other such similar enclosure for which preventing access is required. When door panel 140 is in a locked state, bolt 60 is biased downward by a bolt spring exerting vertical force on a bolt spring carrier and an internal housing, thereby securing bolt 60 in the pocket of the strike 30, preventing opening of the door panel 140. Magnets 10, 20 are oriented and secured in the strike 30 and bolt trigger mechanism 40, respectively, such that the magnets repel each other when in vertical alignment, as shown. As magnets 10, 20 align as the door panel 140 moves into a closed position, the repelling force becomes great enough to overcome the forces of friction as well as a trigger spring normally biasing the trigger 40 downward (as shown in FIG. 1). The magnetic repulsion force thus moves trigger 40 upward into the firing mechanism (comprising the trigger housing, a locking shuttle, bolt and bolt carrier, and associated springs), pulling the locking shuttle away from the bolt 60 and allowing bolt 60 to be fired into the pocket of the strike 40 by the release of the compressed bolt spring. The door panel is held closed by the interaction of bolt 60 and strike 30.

Figure 2:
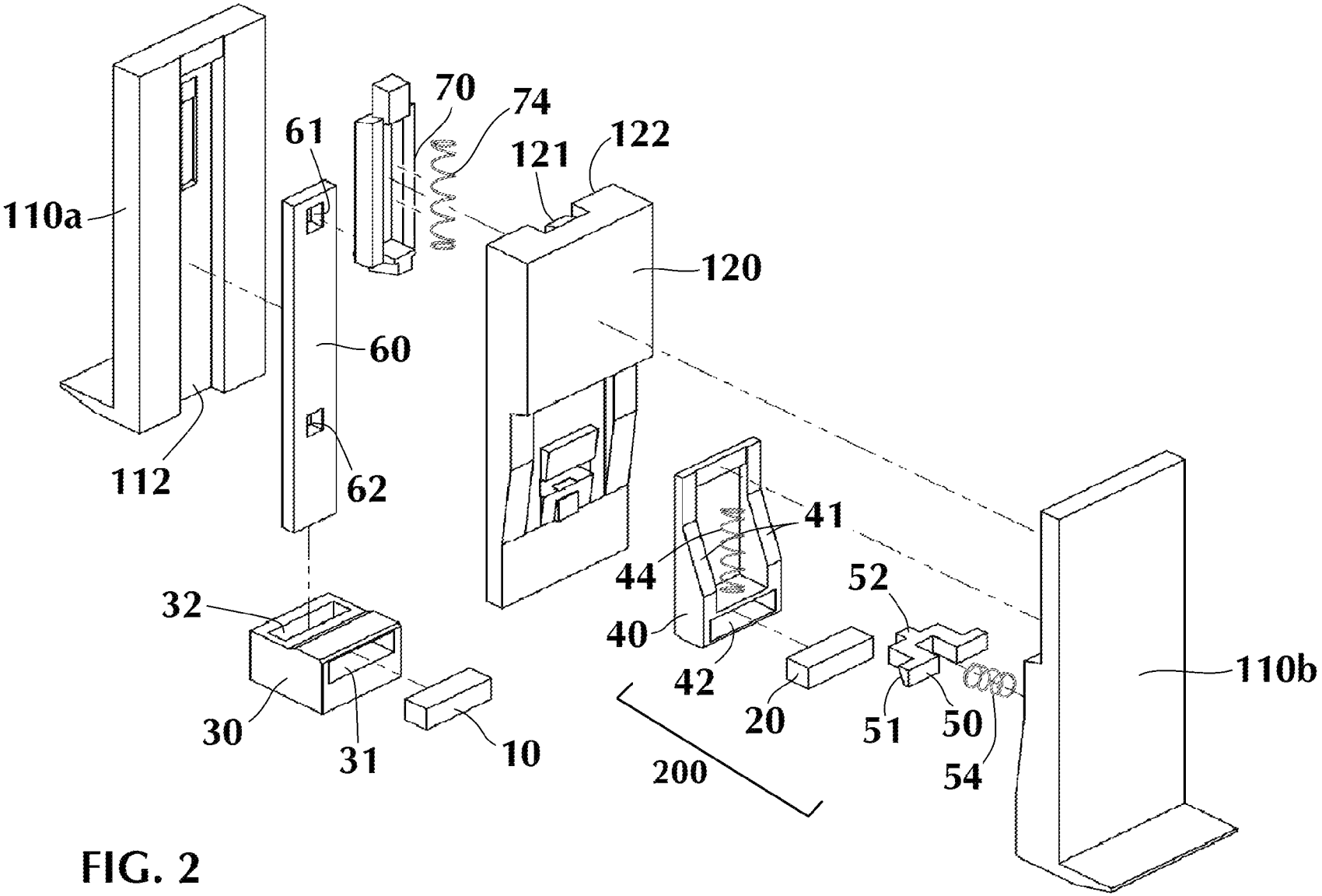
FIG. 2 is an exploded view of the magnetically-triggered lock mechanism shown in FIG. 1.

FIG. 2 shows an exploded view of the magnetically-triggered lock mechanism 100, as seen in FIG. 1. The door panel and frame have been removed for clarity. As can be seen in FIG. 2, lock mechanism 100 comprises a magnetically-triggered bolt assembly held within an outer housing having sides 110*a*, 110*b*. A permanent magnet 10 is mounted within opening 31 in strike 30, whereby strike 30 may be positioned, for example, in the bottom of a door or window frame as shown in FIG. 1. Strike 30 further includes an opening or pocket 32 for receiving the triggered bolt 60, which translates vertically within a channel 112 on the inner surface of outer housing 110*a*. A corresponding permanent magnet 20 is oriented and mounted within trigger housing 40 such that the adjacent surfaces of magnets 10, 20 have the same polarity and repel each other when in vertical alignment. Trigger housing 40 further comprises at least one angled surface 41 for mating with a correspondingly angled surface 51 on a face of locking shuttle 50. Trigger housing 40, magnet 20, and locking shuttle 50 collectively comprise a magnetically-releasable latch mechanism 200, which latches bolt 60 in a retracted position. Latch mechanism 200 is mounted for movement between a biased latch engaging position and a latch releasing position in a non-common direction of movement of the bolt 60. In the embodiment shown, the latch mechanism translates between latched and unlatched positions in a direction perpendicular to the movement of bolt 60.

Figure 3:
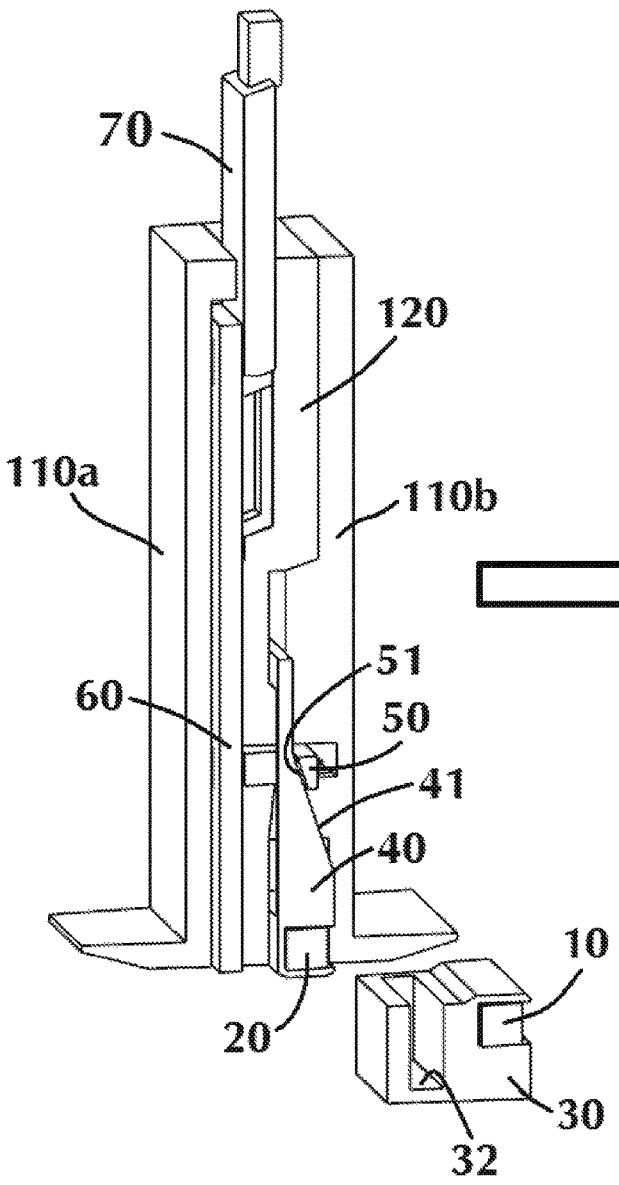
FIG. 3 is a front, cross-sectional view of the magnetically-triggered lock mechanism of the present invention in a fully unlocked state.
Figure 4:
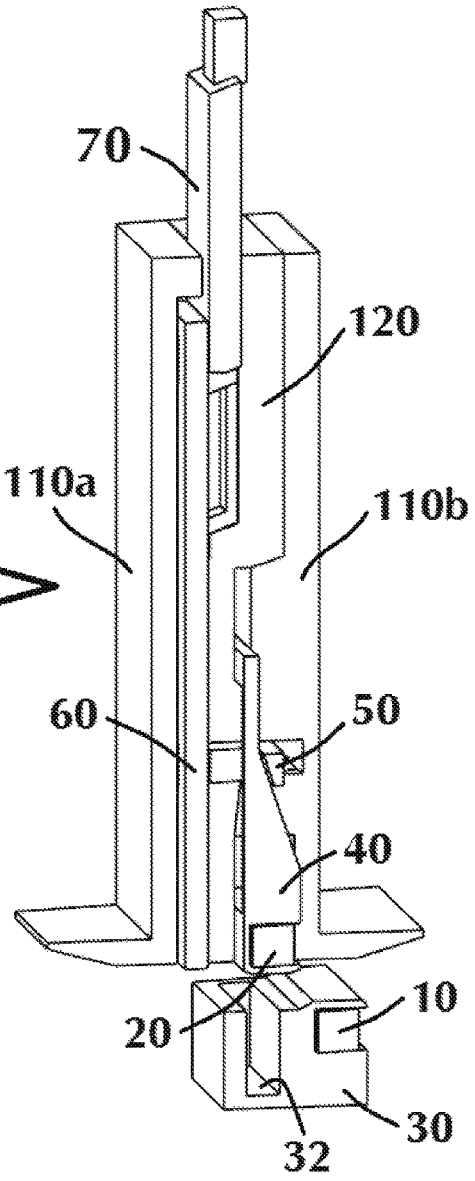
FIG. 4 is a front, cross-sectional view of the lock mechanism shown in FIG. 3 approaching the strike.
Figure 7:
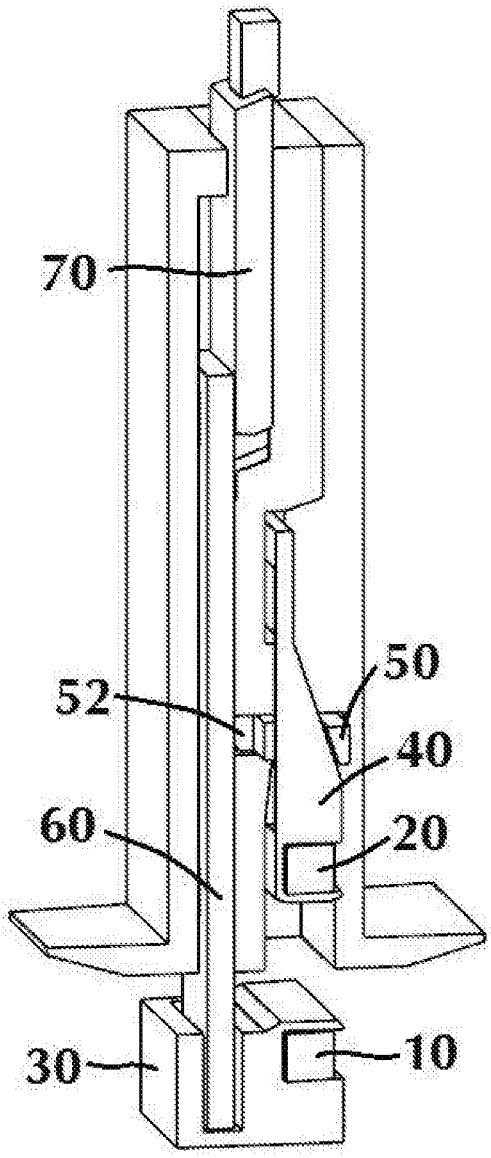
FIG. 7 is a front, cross-sectional view of the lock mechanism shown in FIGS. 3-6 in a fully locked state.
Figure 8:
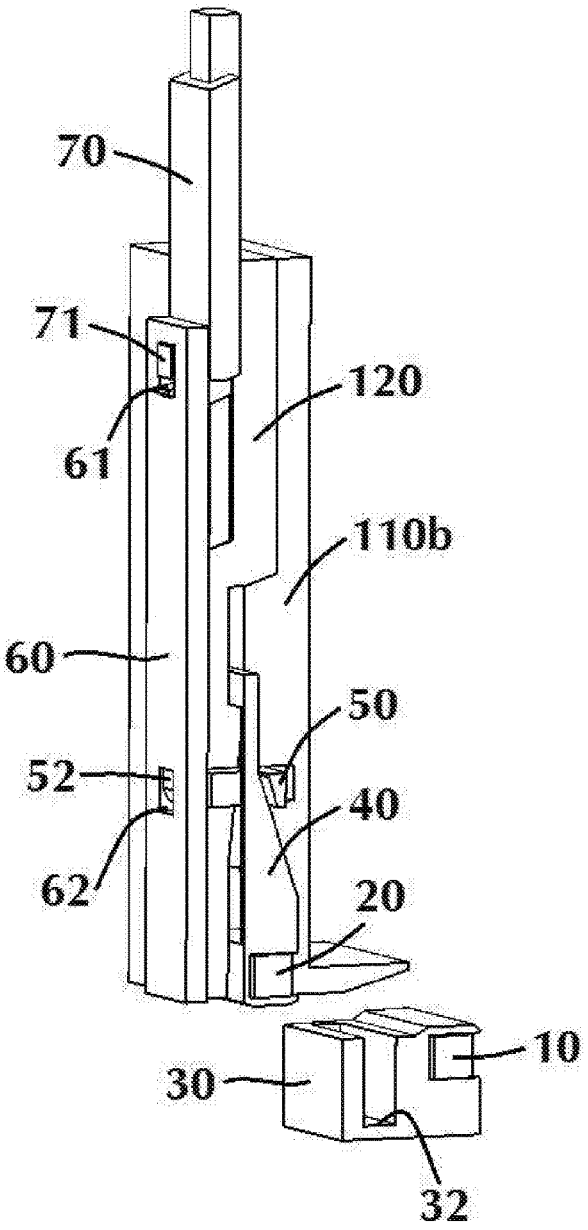
FIG. 8 is a perspective, cross-sectional view of the lock mechanism of the present invention in a fully unlocked state, with a portion of the outer housing removed to show the bolt in a retracted position and the magnetically-releasable latch mechanism in the biased latch engaging position.
Figure 9:
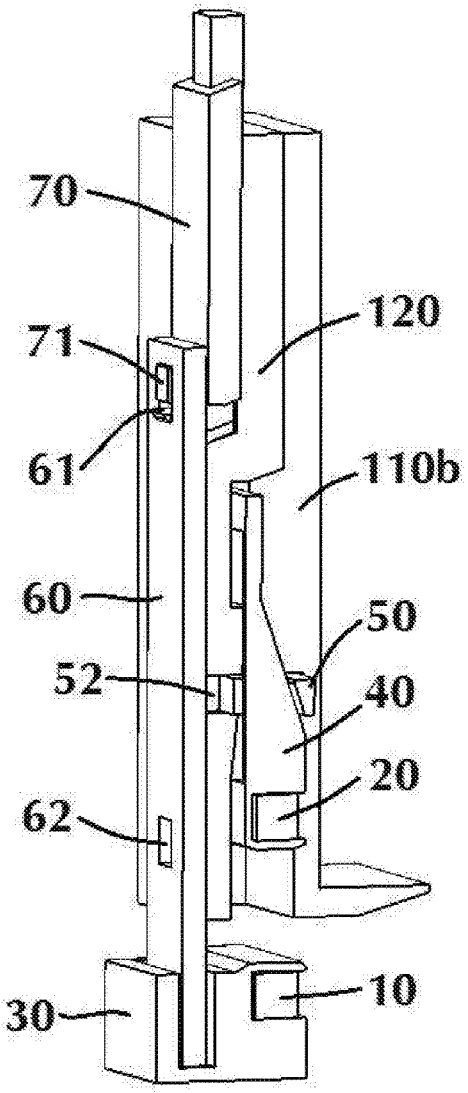
FIG. 9 is a perspective, cross-sectional view of the lock mechanism of the present invention in a locked state, with a portion of the outer housing removed to show the bolt in an extended position and the magnetically-releasable latch mechanism in the latch releasing position.

As further shown in FIG. 2, a bolt spring carrier 70 engages the top portion of bolt 60 at aperture 61 via projection 71 (as shown in FIGS. 8-9) and translates vertically within a channel 121 on surface 122 of inner casing or inner housing 120. Bolt 60 is normally biased downward toward an extended position by a bolt spring 74 within carrier 70; however when the door or window is open, bolt 60 is maintained in a retracted position by locking shuttle 50. When the latching mechanism 200 is in the latched position, projection 52 on locking shuttle 50 extends within aperture 62 of bolt 60 to lock the bolt in position relative to the firing mechanism and prevent vertical movement of the bolt 60 (FIGS. 3, 8). When the latch is released, i.e., when locking shuttle projection 52 is retracted from bolt aperture 62 by translation of the locking shuttle, the bolt is permitted to fire downward into an opening 32 in the strike (FIGS. 7, 9).

FIGS. 3-7 show the lock mechanism transitioning from an unlocked state to a locked state, thereby interengaging the two relatively moveable components, such as a door or window panel and associated frame, as shown in FIG. 1.

FIG. 3 shows the locking mechanism 100 in a fully unlocked state. Force has been applied upwards to the bolt spring carrier 70, compressing the bolt spring 74 (not shown, for clarity) and pulling bolt 60 out of the pocket or opening 32 of the strike 30, allowing the door panel to move to an open position. Generally, as the firing mechanism (comprising the trigger 40, locking shuttle 50, bolt 60 and bolt carrier 70, and associated springs) moves away from the strike assembly 30, the repelling force between magnets 10 and 20 decreases, allowing the trigger spring 44 (FIG. 2), to decompress, and force the trigger housing 40 towards the outside of the firing mechanism. As the trigger 40 moves to the outside of the firing mechanism, shuttle 50 is biased towards bolt 60 by a shuttle spring 54 (FIG. 2), locking the bolt 60 in a latched position relative to the firing mechanism and preventing vertical movement of the bolt 60 as the door is opened.

FIG. 8 shows locking mechanism 100 in a fully unlocked state, with a portion of the outer housing 110*a* removed. As shown in FIG. 8, bolt 60 in a retracted position and the locking shuttle 50 is in a biased latch engaging position. More specifically, a shuttle spring is normally biasing shuttle 50 in the direction of bolt 60, such that locking shuttle projection 52 is extended within bolt aperture 62 to maintain the bolt 60 in a retracted position. As shown in FIG. 8, when the locking shuttle is in the biased latch engaging position, the locking shuttle is approximately at a top portion of the angled mating surface of the trigger 40.

Figure 5:
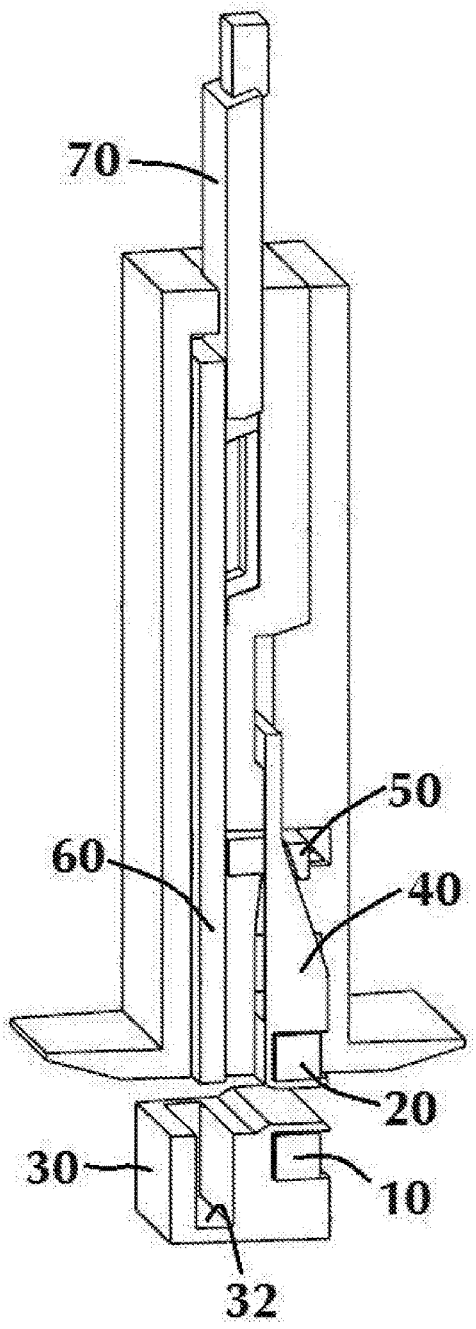
FIG. 5 is a front, cross-sectional view of the lock mechanism shown in FIGS. 3-4 aligned with the strike.
Figure 6:
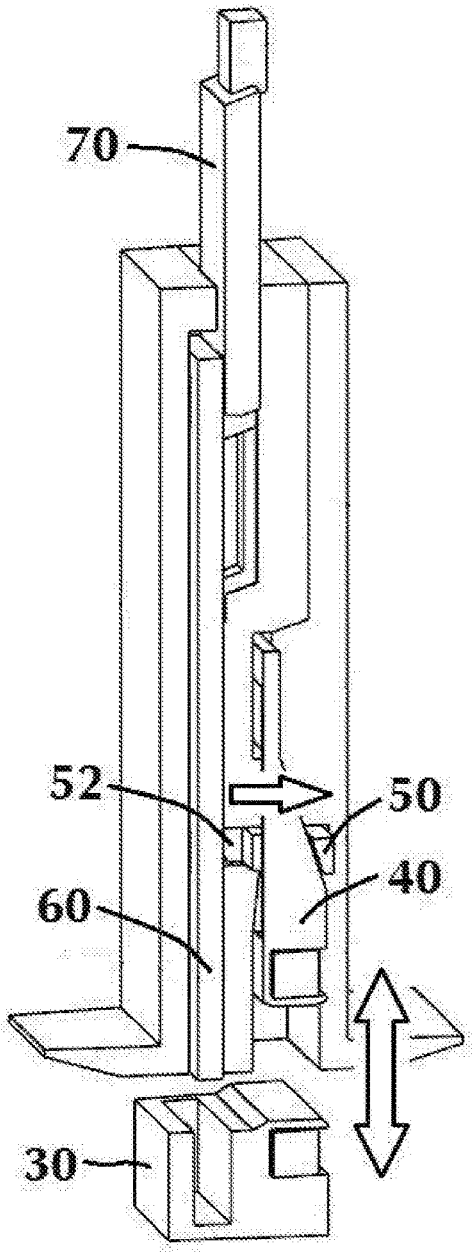
FIG. 6 is a front, cross-sectional view of the lock mechanism shown in FIG. 3-5 with the locking shuttle disengaged from the bolt and just prior to triggering the bolt to extend into the strike.

Referring now to FIGS. 5-7, as the firing mechanism approaches the strike assembly 30 during movement of the door panel to a closed position, magnets 10 and 20 begin to repel one another and the repelling force between the magnets becomes great enough to overcome the forces of friction and the trigger spring 44 (not shown, for clarity). The magnetic repulsion between magnets 10, 20 urges trigger housing 40 upwards, into the firing mechanism. The angled mating surfaces 41, 51 of the trigger housing 40 and shuttle 50, respectively, convert the vertical motion of the trigger 40 (which houses magnet 20) into horizontal motion of the shuttle 50. As shown in the transition between FIG. 5 to FIG. 6, the magnetic repulsion between magnets 10, 20 compresses the trigger spring 44 and moves the trigger housing 40 and magnet 20 into the firing mechanism, pulling the shuttle 50 away from the bolt 60 and compressing the shuttle spring 54 (not shown, for clarity), which normally biases the shuttle towards the bolt 60. Shuttle projection 52 is thus retracted from bolt aperture 62 by translation of shuttle 50, as shown in FIG. 6. As the bolt 60 is now free to move vertically, the compressed bolt spring 74 is released, pushing the bolt spring carrier 70 and bolt 60 outward and firing the bolt into the pocket 32 of the strike 30, thereby preventing movement of the door panel, as shown in FIG. 7. It should be understood by those skilled in the art that, in operation, the locking steps as shown in FIGS. 5 to 7 are happening near-simultaneously; however, the steps are being shown as discrete actions to more clearly depict the motion.

FIG. 9 shows locking mechanism 100 in a fully locked state, with a portion of the outer housing 110*a* removed. As shown in FIG. 9, bolt 60 in an extended position and the locking shuttle 50 is in the latch releasing position. The magnetic repulsion between magnets 10, 20 has urged trigger housing 40 upwards (as compared to FIG. 8, for example), into the firing mechanism, and the angled mating surfaces of the trigger housing 40 and shuttle 50, respectively, have converted the vertical motion of the trigger 40 into horizontal motion of the shuttle 50, moving the shuttle into the latch releasing position and retracted locking shuttle projection 52 from bolt aperture 62, such that the bolt has been permitted to fire downward into opening 32 in strike 30. As shown in FIG. 9, when the locking shuttle 50 is in the latch releasing position, the locking shuttle is located near a bottom portion of the angled mating surface of the trigger 40.

To return to an unlocked state, force may be applied upwards to the bolt spring carrier 70, such as by rotating a door handle, compressing the bolt spring in bolt spring carrier 70 and pulling bolt 60 out of the pocket of the strike 30. As the door panel (including the firing mechanism) moves away from the strike assembly 30 during opening of the door, the repelling force between magnets 10 and 20 decreases, allowing the trigger spring to decompress and biasing the trigger housing 40 towards the outside of the firing mechanism. As the trigger 40 moves to the outside of the firing mechanism, shuttle 50 is biased towards bolt 60 by the shuttle spring, latching the bolt in a retracted position relative to the firing mechanism by the re-engagement of locking shuttle projection 52 with bolt aperture 62, as described above.

It should be understood by those skilled in the art that the configuration of the lock mechanism of the present invention as shown in FIGS. 1-9, inclusive, and in particular the configuration of the bolt, locking shuttle and trigger, is shown as configured for exemplary purposes only, and that other configurations are within the intended scope of the present invention, so long as the magnetic repulsion between the magnets located in the first and second components, respectively, causes the magnetically-releasable latch mechanism to move from a biased latch engaging position to a latch releasing position via the interaction between the locking shuttle and the trigger to allow the bolt to fire to interengage the first and second components.

Thus, the present invention achieves one or more of the following advantages. The magnetically-triggered bolt assembly provides an improved means for preventing access to the interior of an enclosure and ensures that the bolt is extended only after the two components, such as a window frame and sill, are in the appropriate position relative to each other. Magnets secured in the strike and trigger mechanism for the bolt, respectively, are oriented and positioned such that they repel one another when in alignment, overcoming the force of a trigger spring which normally biases the trigger in a downward direction, and pulling a locking shuttle away from the bolt, thereby allowing a compressed bolt spring to release and fire the bolt downward into the pocket of the strike.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A magnetically-triggered lock mechanism for interengaging two relatively movable components, comprising:

a bolt displaceable between extended and retracted positions and normally biased toward the extended position, the bolt mounted within a first component and interengageable with a second component when the first and second components are in a predetermined position relative to each other and the bolt is extended;

a magnetically-releasable latch mechanism positioned to latch the bolt in the retracted position, the latch mechanism including a first magnet disposed within a trigger housing being translatable along an axis parallel to a longitudinal axis of the bolt, and mounted for movement between a biased latch engaging position and a latch releasing position in a non-common direction of movement of the bolt; and a second magnet positioned to displace the latch mechanism to the latch releasing position when the first component is in the predetermined position relative to the second component, wherein translation of the trigger housing in a vertical direction as a result of magnetic communication between the first and second magnets causes the latch mechanism to move from the biased latch engaging position to the latch releasing position to displace the bolt to the extended position.

2. The lock mechanism of claim 1 wherein the first and second magnets are positioned to displace the latch mechanism to the latch releasing position as a result of magnetic repulsion when the first component is in the predetermined position relative to the second component.

3. The lock mechanism of claim 1 wherein the magnetically-releasable latch mechanism comprises a locking shuttle in communication with the trigger housing, the locking shuttle adapted to move in a direction perpendicular to the movement of the trigger housing as the latch mechanism moves between the biased latch engaging position and the latch releasing position.

4. The lock mechanism of claim 3 wherein the trigger housing includes at least one angled surface for mating with an angled surface of the locking shuttle, and wherein the mating angled surfaces of the trigger housing and locking shuttle translate vertical movement of the trigger housing into horizontal movement of the locking shuttle when the first component is in the predetermined position relative to the second component and the first and second magnets are positioned to displace the latch mechanism to the latch releasing position.

5. The lock mechanism of claim 3 wherein the locking shuttle comprises a projection and the bolt comprises an aperture for receiving the locking shuttle projection when the latch mechanism is in the biased latch engaging position.

6. The lock mechanism of claim 1 wherein the first component is a door or window panel, and the second component is a frame associated with the door or window panel.

7. The lock mechanism of claim 6 wherein the second magnet is at least partially located within a recess in the frame.

8. The lock mechanism of claim 1 wherein the bolt is normally biased toward the extended position by a spring disposed within a bolt carrier engaged with the bolt.

9. The lock mechanism of claim 1 further including an outer housing comprising a channel in an inner surface thereof, and wherein the bolt translates vertically within the channel as the bolt moves between extended and retracted positions.

10. A door or window assembly, comprising:

a door or window panel moveable relative to an associated frame; and a magnetically-triggered lock mechanism for interengaging the panel and the frame, the lock mechanism comprising a bolt displaceable between extended and retracted positions and normally biased toward the extended position, the bolt mounted within the door or window panel and interengageable with the frame when the door or window panel and frame are in a predetermined position relative to each other and the bolt is extended; a magnetically-releasable latch mechanism positioned to latch the bolt in the retracted position, the latch mechanism including a first magnet disposed within a trigger housing being translatable along an axis parallel to a longitudinal axis of the bolt, and mounted for movement between a biased latch engaging position and a latch releasing position in a non-common direction of movement of the bolt; and a second magnet positioned to displace the latch mechanism to the latch releasing position when the door or window panel is in the predetermined position relative to the frame, wherein translation of the trigger housing in a vertical direction as a result of magnetic communication between the first and second magnets causes the latch mechanism to move from the biased latch engaging position to the latch releasing position to displace the bolt to the extended position.

11. The door or window assembly of claim 10 wherein the first and second magnets are positioned to displace the latch mechanism to the latch releasing position as a result of magnetic repulsion when the door or window panel is in the predetermined position relative to the frame.

12. The door or window assembly of claim 10 wherein the magnetically-releasable latch mechanism comprises a locking shuttle in communication with the trigger housing, the locking shuttle adapted to move in a direction perpendicular to the movement of the trigger housing as the latch mechanism moves between the biased latch engaging position and the latch releasing position.

13. The door or window assembly of claim 12 wherein the trigger housing includes at least one angled surface for mating with an angled surface of the locking shuttle, and wherein the mating angled surfaces of the trigger housing and locking shuttle translate vertical movement of the trigger housing into horizontal movement of the locking shuttle when the door or window panel is in the predetermined position relative to the frame and the first and second magnets are positioned to displace the latch mechanism to the latch releasing position.

14. The door or window assembly of claim 12 wherein the locking shuttle comprises a projection and the bolt comprises an aperture for receiving the locking shuttle projection when the latch mechanism is in the biased latch engaging position.

15. The door or window assembly of claim 10 wherein the second magnet is at least partially located within a recess in the frame.

16. The door or window assembly of claim 10 wherein the bolt is received in an opening in a strike in the frame when the bolt is in the extended position.

17. The door or window assembly of claim 10 wherein the bolt is normally biased toward the extended position by a spring disposed within a bolt carrier engaged with the bolt.

18. The door or window assembly of claim 10 further including an outer housing comprising a channel in an inner surface thereof, and wherein the bolt translates vertically within the channel as the bolt moves between extended and retracted positions.

19. A method of interengaging two relatively movable components to prevent access to an interior of an enclosure, comprising:

providing a bolt displaceable between extended and retracted positions and normally biased toward the extended position, the bolt mounted within a first component and interengageable with a second component when the first and second components are in a predetermined position relative to each other and the bolt is extended;

providing a magnetically-releasable latch mechanism positioned to latch the bolt in the retracted position, the latch mechanism including a first magnet disposed within a trigger housing being translatable along an axis parallel to a longitudinal axis of the bolt, and mounted for movement between a biased latch engaging position and a latch releasing position in a non-common direction of movement of the bolt as a result of translation of the trigger housing in a vertical direction;

providing a second magnet positioned to displace the latch mechanism to the latch releasing position when the first component is in the predetermined position relative to the second component;

locating the first and second components in the predetermined position relative to each other;

causing the latch mechanism to move to the latch releasing position via translation of the trigger housing as a result of magnetic interaction between the first and second magnets; and displacing the bolt to the extended position to interengage the second component.

20. The method of claim 19 wherein the magnetic interaction between the first and second magnets comprises magnetic repulsion.

21. The method of claim 19 wherein the magnetically-releasable latch mechanism comprises a locking shuttle in communication with the trigger housing, and wherein the step of causing the latch mechanism to move to the latch releasing position as a result of magnetic interaction between the first and second magnets further comprises:

moving the locking shuttle in a direction perpendicular to the movement of the trigger housing as the latch mechanism moves between the biased latch engaging position and the latch releasing position.

22. The method of claim 21 wherein the locking shuttle comprises a projection and the bolt comprises an aperture for receiving the locking shuttle projection when the latch mechanism is in the biased latch engaging position, and wherein the step of causing the latch mechanism to move to the latch releasing position as a result of magnetic interaction between the first and second magnets further comprises:

retracting the locking shuttle projection from the bolt aperture to allow the bolt to be displaced to the extended position.

23. The method of claim 21 wherein the trigger housing includes at least one angled surface for mating with an angled surface of the locking shuttle, and wherein the step of causing the latch mechanism to move to the latch releasing position as a result of magnetic interaction between the first and second magnets further comprises:

translating vertical movement of the trigger housing into horizontal movement of the locking shuttle via the mating angled surfaces of the trigger housing and locking shuttle as the latch mechanism moves to the latch releasing position.

24. The method of claim 19 wherein the first component is a door or window panel, and the second component is a frame associated with the door or window panel.

* * * * *